US006214192B1

(12) United States Patent
Hawkins et al.

(10) Patent No.: US 6,214,192 B1
(45) Date of Patent: Apr. 10, 2001

(54) FABRICATING INK JET NOZZLE PLATE

(75) Inventors: Gilbert A. Hawkins, Mendon; Xin Wen, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/208,358

(22) Filed: Dec. 10, 1998

(51) Int. Cl.[7] ..... C25D 1/10; C25D 7/00
(52) U.S. Cl. ..... 205/50; 205/118; 205/70
(58) Field of Search ..... 205/118, 69, 70, 205/50

(56) References Cited

U.S. PATENT DOCUMENTS

| | | | | |
|---|---|---|---|---|
| 3,946,398 | | 3/1976 | Kyser et al. . | |
| 4,430,784 | * | 2/1984 | Brooks et al. | 29/157 C |
| 4,460,728 | | 7/1984 | Puletti et al. . | |
| 4,490,728 | | 12/1984 | Vaught et al. . | |
| 4,658,269 | * | 4/1987 | Rezanka | 346/75 |
| 4,723,129 | | 2/1988 | Endo et al. . | |
| 4,791,436 | * | 12/1988 | Chan et al. | 346/140 R |
| 4,829,319 | * | 5/1989 | Chan et al. | 346/1.1 |
| 4,894,664 | * | 1/1990 | Pan | 346/1.1 |
| 5,167,776 | * | 12/1992 | Bhaskar et al. | 205/75 |
| 5,443,713 | * | 8/1995 | Hindman | 205/70 |
| 5,501,784 | * | 3/1996 | Lessmollmann et al. | 205/67 |

FOREIGN PATENT DOCUMENTS

| | | |
|---|---|---|
| 827 833 A2 | 7/1997 | (EP) . |
| 98/08687 | 8/1997 | (WO) . |

* cited by examiner

*Primary Examiner*—Kathryn Gorgos
*Assistant Examiner*—Erica Smith-Hicks
(74) *Attorney, Agent, or Firm*—Raymond L. Owens

(57) ABSTRACT

A method for forming an ink jet nozzle plate with ink jet nozzles, including providing a first mold formed with spaced-apart recesses; providing inlay material in the spaced-apart recesses; attaching a base to the inlay material; separating the first mold from the inlay material and the base, thereby forming a final mold having a plurality of inlay material protrusions over the base, the protrusions and base defining the shape and the size of the ink jet nozzles; providing plate forming material between the protrusions and over the base in the final mold; and releasing the plate forming material to form an ink jet nozzle plate having a plurality of ink jet nozzles.

17 Claims, 5 Drawing Sheets

FABRICATING INK JET NOZZLE PLATE

FIELD OF THE INVENTION

The present invention relates to the fabrication of ink jet nozzle plates for ink jet printing apparatus.

BACKGROUND OF THE INVENTION

Ink jet printing has become a prominent contender in the digital output arena because of its non-impact, low-noise characteristics and its compatibility with plain paper. Ink jet printings avoids the complications of toner transfers and fixing as in electrophotography and the pressure contact at the printing interface as in thermal resistive printing technologies. Ink jet printing mechanisms includes continuous ink jet and drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. EP 827 833 A2 and WO 98/08687 disclose a piezoelectric ink jet print head apparatus with reduced crosstalk between channels, improved ink protection, and capability of ejecting variable ink drop size.

U.S. Pat. No. 4,723,129 issued to Endo et al discloses an electrothermal drop-on-demand ink jet printer which applies a power pulse to an electrothermal heater which is in thermal contact with water based ink in a nozzle. A small quantity of ink rapidly evaporates, forming a bubble which causes an ink drop to be ejected from small apertures along the edge of the heater substrate. This technology is known as Bubblejet™ (trademark of Canon K.K. of Japan).

U.S. Pat. No. 4,460,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

Ink jet nozzles are an essential component in an ink jet printer. The shapes and dimensions of the ink jet nozzles strongly affect the properties of the ink drops ejected from that ink jet nozzle. For example, it is well known in the art that if the diameter of the ink jet nozzle opening deviates from the desired size, both ink drop volume and the velocity can vary from the desired values. In another example, if the opening of an ink jet nozzle is formed with an irregular shape, the trajectory of the ejected ink drop from that ink jet nozzle can also deviate from the desired direction (usually normal to the plane of the nozzle plate).

One method of forming ink jet nozzle plates is the electroforming process. Such a process uses a mandrel overcoated with a continuous conductive film patterned and non-conductive structures that protrude over the conductive film. A metallic nozzle plate is formed using such a mandrel by electroplating on the conductive film. Over time, the metallic layer grows in thickness. The ink jet nozzles are defined by the non-conductive structures.

One known problem in the above-described prior art is in the variability of the diameter of the ink jet nozzles. The growth rate of the metallic layer can vary at different areas of the mandrel in the electroforming process as well as between different batches. The growth rate variability results in variability in the size of the openings as defined by the edge of the growth front of the metallic layer. This problem is particularly severe for forming ink jet nozzles with small diameters. A slight variability in the growth rate of the metallic layer in the electroplating process will result in a large relative error in the nozzle diameter.

Another need for ink jet nozzles in an ink jet printing apparatus is to optimize the shape of ink jet nozzle exit and the ink funnel that feed the ink fluid to the ink jet nozzles. It is known that the ink funnel can exist in cone, cylindrical, or toroidal shapes. The ink jet nozzle can be round, square or triangular. The structural designs of the ink jet nozzles and ink funnels strongly influence the dynamics of the ink fluid during ink drop ejection, and therefore determine to a large extent the properties of the ejected ink drop.

SUMMARY OF THE INVENTION

An object of the present invention is to provide high quality ink jet nozzle for use in ink jet cartridges.

Another object is to provide ink jet nozzles with high precision and tolerances using conventional semiconductor fabrication techniques.

These objects are achieved by a method for forming an ink jet nozzle plate with ink jet nozzles, comprising the steps of:

a) providing a first mold formed with spaced-apart recesses;

b) providing inlay material in the spaced-apart recesses;

c) attaching a base to the inlay material;

d) separating the first mold from the inlay material and the base, thereby forming a final mold having a plurality of inlay material protrusions over the base, the protrusions and base defining the shape and the size of the ink jet nozzles;

e) providing plate forming material between the protrusions and over the base in the final mold; and f) releasing the plate forming material to form an ink jet nozzle plate having a plurality of ink jet nozzles.

ADVANTAGES

An advantage of the present invention is that ink jet nozzles for ink jet cartridges are effectively provided and with precise tolerance such that the ink drop ejection properties can be optimized.

A further advantage of the present invention is that the fabrication methods in the present invention can produce different shapes in the ink jet nozzle for improved ink drop injection.

Yet a further advantage of the present invention is that the size of the ink jet nozzle is insensitive to variations in the conditions of manufacture.

DETAILED DESCRIPTION OF THE INVENTION

The present invention is described with relation to the formation of ink jet nozzle plates. Specifically, the present invention relates to providing a mold for forming an ink jet nozzle plate.

Figure 1A:
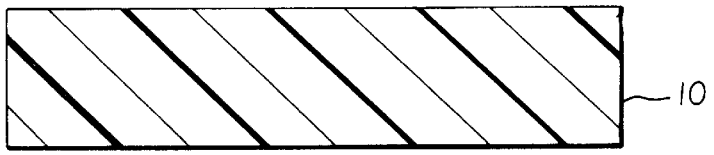
FIGS. 1*a*–1*l* illustrate a series of steps that are used in practicing the method of the present invention to produce an ink jet nozzle plate in accordance with a first embodiment of the present invention.

The first embodiment of the present invention is depicted in FIGS. 1*a* to 11. In FIG. 1*a*, there is provided a substrate 10, preferably a silicon wafer substrate of crystallographic orientation, commonly used for semiconductor Integrated Circuitry (IC) manufacture. In FIG. 1*b*, a mask 20 is next provided on the substrate 10. The mask is preferably silicon dioxide that can be thermally grown on the substrate 10. The mask 20 can also be silicon nitride that can be deposited by low pressure Chemical Vapor Deposition (CVD).

Figure 1B:
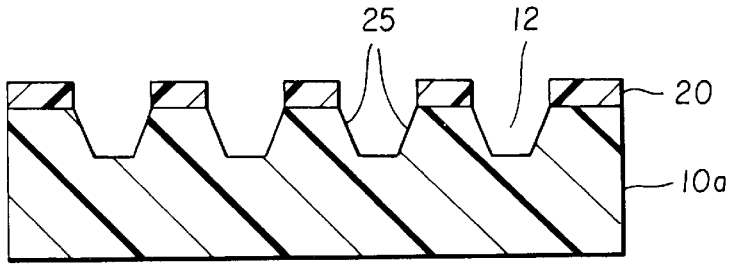

The substrate 10 is next modified, as shown in FIG. 1*b*, to form a modified substrate 10*a*. The mask 20 is first uniformly coated by a photoresist such as KTI 820. Selective areas on the mask 20 are patterned photo-lithographically on the photoresist layer. The selected areas of the mask 20 are removed by chemical etching. The silicon wafer substrate 10 under the selected areas is subsequently etched to form a plurality of first etched regions 12 in the modified substrate 10*a*. The etching can be made by a wet etchant having an aqueous solution of potassium hydroxide (KOH). This etchant forms first inclined walls 25, as is well known in the art of semiconductor processing, that are defined by the [111] crystalline planes of silicon.

Figure 1C:
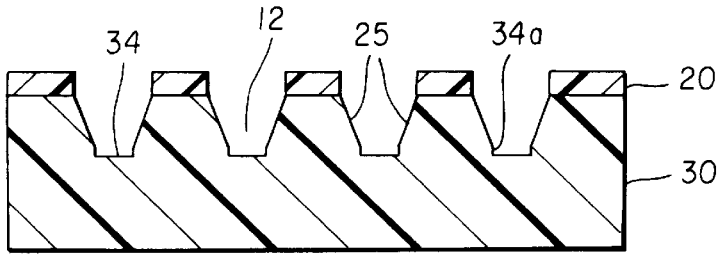
Figure 1D:
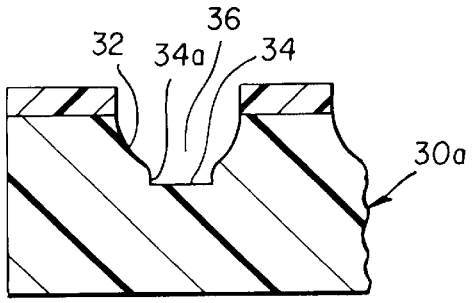

Next, referring to FIG. 1*c*, the modified substrate 10*a* is further subjected to an anisotropic dry etch, preferably by a high density plasma etch, which etches the modified substrate 10*a* vertically at the bottom surfaces of the first etched regions 12. The dry etching step thereby creates recesses 34 with vertical recess sides 34*a*, FIG. 1*e*, typically extending 1 to 50 microns into the modified substrate 10*a*, while leaving the first inclined walls 25 in the first etched region 12 substantially unchanged. A first mold 30 is thereby formed from themodified substrate 10*a*. A top view of the first mold is shown in FIG. 1*d*.

Figure 1E:
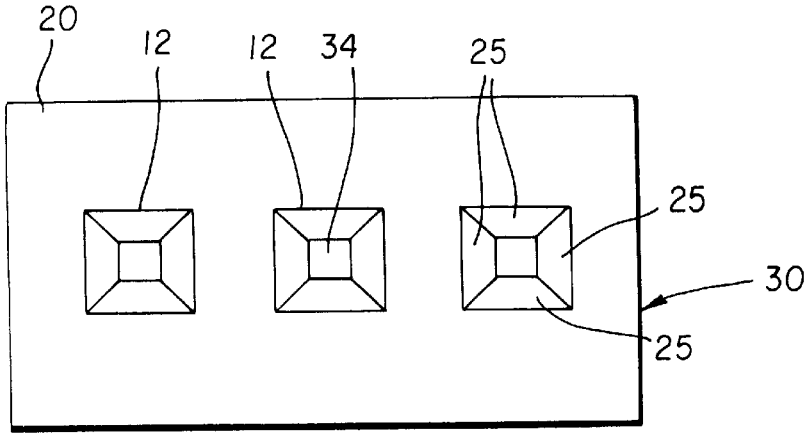
Figure 1F:
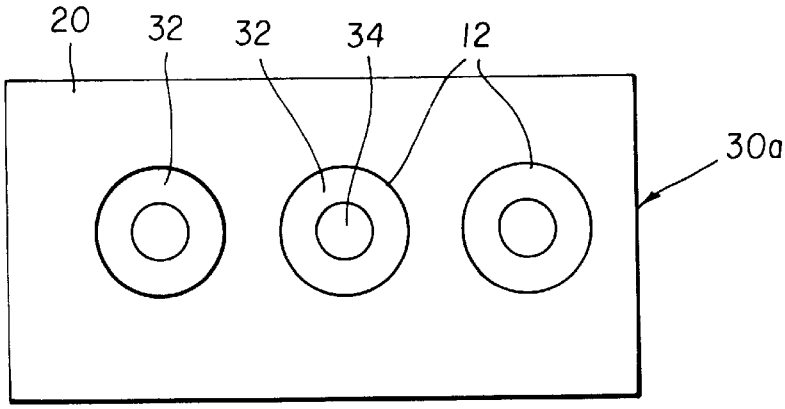

In the field of ink jet printing, it is usually desirable to optimize the shapes of the internal walls in an ink jet nozzle. These optimized shapes may include curved surfaces rather than flat faces as defined by a crystalline plane such as the silicon planes. In addition, the internal walls and the ink jet nozzles are often preferably to be round or cylindrically symmetric around the ink jet nozzle axis. In accordance to the present invention, as it will be understood in the description below, these above requirements can be achieved by a shaped etch region 36 defined by a curved and round shaped side wall 32, as shown in FIG. 1*e*. The shaped etch regions 36 can be formed in the modified substrate 10*a* by a plasma etch that is capable of both isotropic and anisotropic etching. The plasma etch forms the shaped side walls 32 to an optimized shape and symmetry. The shaped side walls 32 can be made to be either isotropic or anisotropic around the axis of the shaped etch region 36. As in the previous case, an anisotropic dry etch can then be used to form recesses 34 with vertical recess sides 34*a*, as shown in FIG. 1*e*. A top view of a first mold 30*a* achieved by forming round shaped side walls 32 is shown in FIG. 1*f*.

Figure 1G:
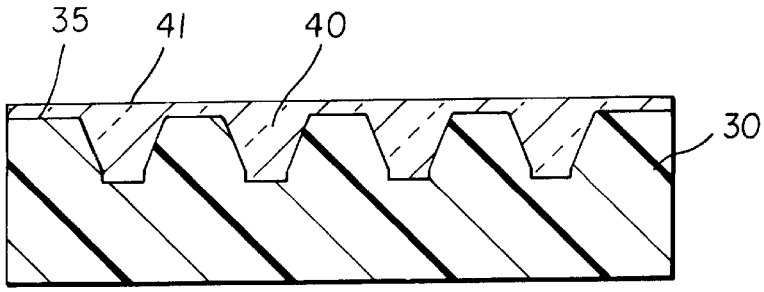

In accordance to the present invention, the following descriptions in relation to FIGS. 1*g*–11 can be similarly applied using either the first mold 30 or the first mold 30*a*, as respectively illustrated in FIGS. 1*c* and 1*e*. Referring now to FIG. 1*g*, the mask 20 is next removed by oxygen plasma stripping from the first mold 30 (or 30*a*). A first inlay 40 is provided inside first etched regions 12 and the recess 34 and over the top surface 35 of first mold 30. The first inlay 40 can be spin-coated by polymeric materials such as silicon rubber, polyimides, polymethyl methacrylate, or hydrofluorocarbons such as Teflon, made by the duPont Company. The first inlay 40 can also be deposited by planarizable materials well known in the art of semiconductor manufacturing: boron containing silicon oxides or mixtures of silicon oxide and silicon nitride. Preferably, the top surface 41 of first inlay 40 is planar. Planarization techniques such as chemical mechanical polishing can be used to render the top surface 41 to be substantially planar.

Figure 1H:
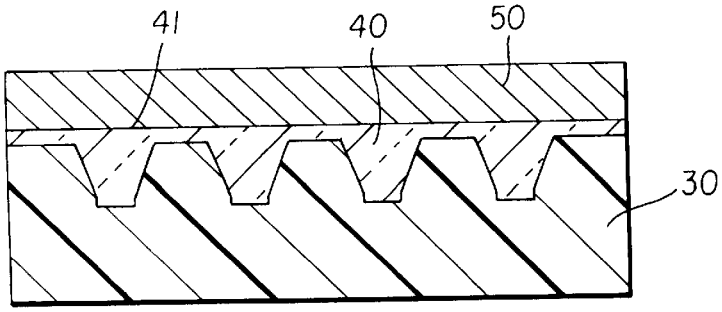
Figure 1I:
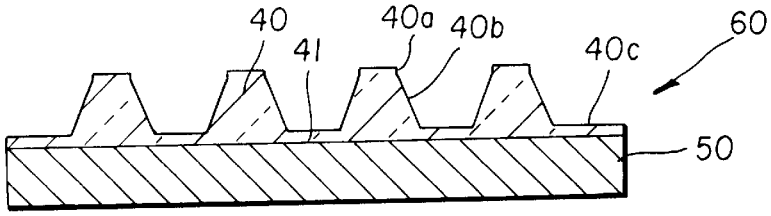

Next, in FIG. 1*h*, a base 50, made of an electrically conductive material such as aluminum, is attached to top surface 41 by, for example, thermal bonding or epoxy bonding between base 50 and top surface 41. After the bonding is complete, the modified substrate (30 (or 30*a* ) is removed to form a released portion 60, shown in FIG. 1*i*, comprising the base 50 and the first inlay 40 that is bounded by the vertical walls 40*a*, second inclined walls 40*b*, and horizontal portion 40*c*. The vertical wall 40*a*, originally created by vertical recess side 34*a* of recess 34, is essential for providing ink jet nozzle diameters with low manufacturing variability. The removal of the modified substrate 10*a* is preferably conducted by first grinding away a large portion of the material and then by etching away the remainder by a fluorine based plasma etch. Alternatively, it is known in the art that a thin release layer such as an oxide can be deposited in the first mold before providing first inlay 40. The released portion 60 can then be separated from the first mold 30 by chemically dissolving the thin release layer.

Figure 1J:
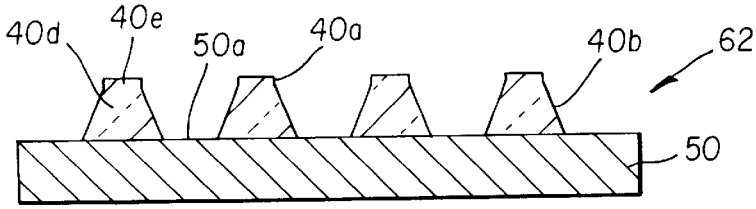

Referring to FIG. 1*j*, the horizontal portion 40*c* of the material of first inlay 40 is etched away using an anisotropic etch, such as an oxygen reactive ion plasma etch, to expose a conductive surface 50*a* on the base 50, thereby forming final mold 62. The shape of the vertical walls 40*a* and second inclined walls 40*b* are substantially unchanged by this etch. In particular, the vertical walls 40*a* remain vertical, due to the anisotropic nature of the etch. The final mold 62 includes the continuous conductive surface 50*a* and non-conductive protrusions that are defined by the vertical walls 40*a* and second inclined walls 40*b*. Each protrusion includes a top portion 40*d* with vertical walls 40*a* and a lower portion 40*e* with second inclined walls 40*b*. The vertical walls 40*a* define the ink jet nozzle diameter when the plate forming material is provided between the protrusions.

Figure 1K:
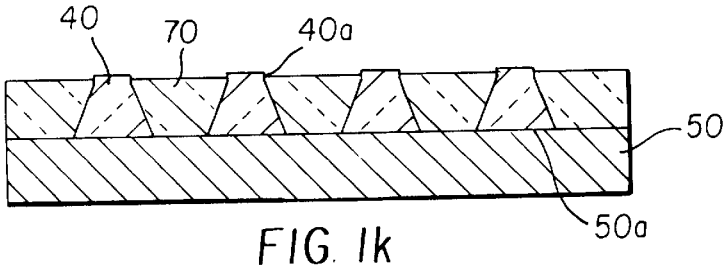
Figure 1L:
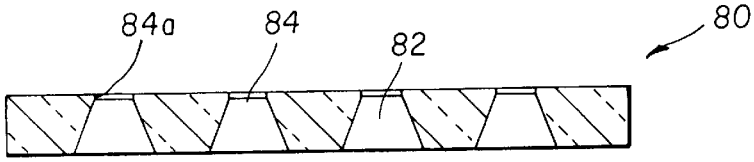

Now referring to FIGS. 1*k* and 11, a second inlay 70 which forms ink jet nozzle plate 80 is made of a hardenable plate forming material. The plate forming material is preferably electroplated into the final mold 62 in an electroforming bath. A metallic layer is grown from the continuous conductive surfaces 50*a*, that is used as an electrode, onto the non-conducting surfaces on the second inclined walls 40*b* and the vertical walls 40*a* on the final mold 62. The metal for electroplating can include nickel, gold, metallic alloys, or metal-organic mixtures as is well known in the art of electroplating. The electrolyte is preferably an aqueous solution comprising salt of the corresponding metallic ions. The second inlay 70 is then removed, for example, by mechanically peeling, from the base 50, to provide the ink jet nozzle plate 80, as shown in FIG. 11. The ink jet nozzle plate 80 comprises bore region 84 with vertical walls 84*a* and cavity regions 82.

In accordance with the present invention, the second inlay 70, shown in FIG. 1*k*, is grown to a height within the height range of the vertical wall 40*a*. In other words, the second inlay 70 does not grow higher than the vertical wall 40*a* of the first inlay 40 nor below the intersection between the vertical wall 40*a* and the second inclined wall 40*b*. In this manner, the bore region 84 of ink jet nozzle plate 80 has an exit diameter that is independent of the exact height of thesecond inlay 70, which reduces the variability in the nozzle diameter in the fabrication process. Moreover, vertical walls 84*a* at the exit end of the bore region 84 are known to be desirable for ink jet nozzle plates.

Figure 2A:
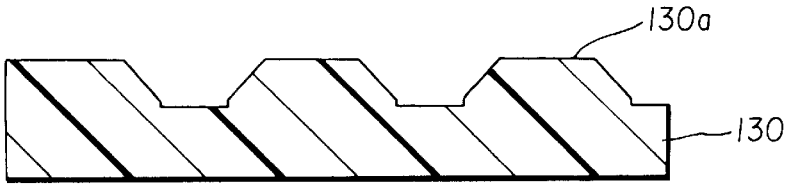
FIGS. 2*a*–2*e* illustrate a series of steps that are used in a second embodiment of the present invention.
Figure 2B:
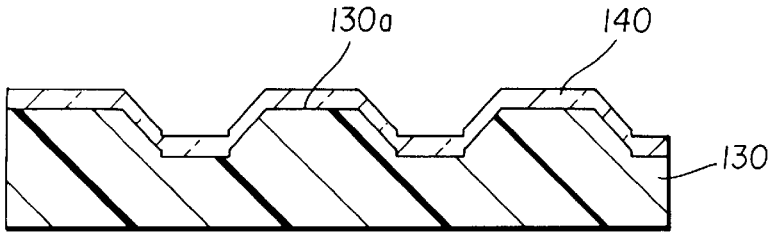
Figure 2C:
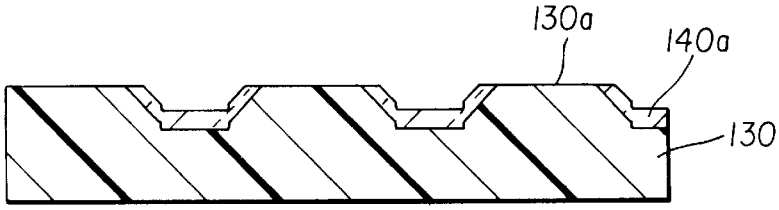
Figure 2D:
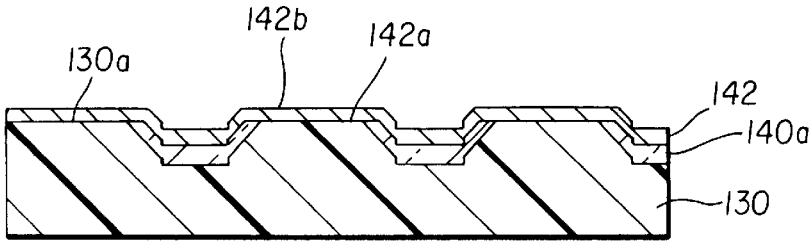
Figure 2E:
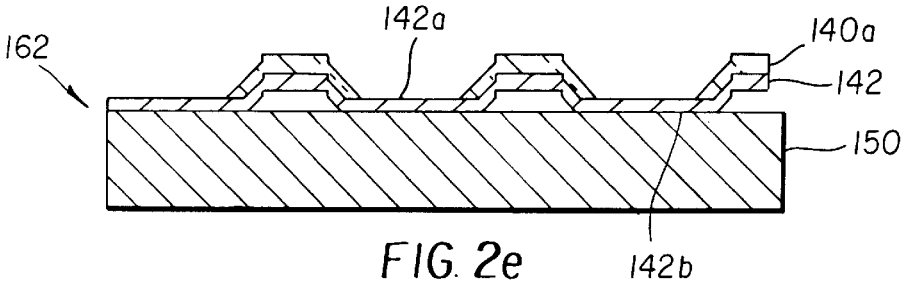

A second embodiment of the present invention is now described in relation to FIGS. 2*a* to 2*e*. This embodiment teaches a different approach for the formation of a final mold for the electroforming process. A first mold 130 of FIG. 2*a* is provided with a conformal insulator 140 in FIG. 2*b*. For example, the first mold 130 can be silicon and the conformal insulator 140 can be silicon oxide. The conformal insulator 140 can also be a deposited film of polymer such as Teflon. The conformal insulator 140 is removed from top surface 130*a* of first mold 130 forming a modified conformal insulator 140*a*, shown in FIG. 2*c*. Next, as shown in FIG. 2*d*, a conductive material 142 is provided over the top surface 130*a* and the modified conformal insulator 140*a*. The bottom surface 142*a* of the conductive material 142 is in contact with top surface 130*a*. Final mold 162 is then made by bonding top surface 142*b* of the conductive material 142 to a base 150 and removing the first mold 130 as shown in FIG. 2*e*. The first mold 130 can be removed, for example, by mechanical grinding, or chemical or plasma etching. The structure is shown inverted in FIG. 2*e* with bottom surface 142*a* upwards to provide a continuous conductive surface to be used as an electrode in the electroplating process for forming the metallic ink jet nozzle plate, similar to the description in relation to FIGS. 1*k* and 11 .

Figure 3A:
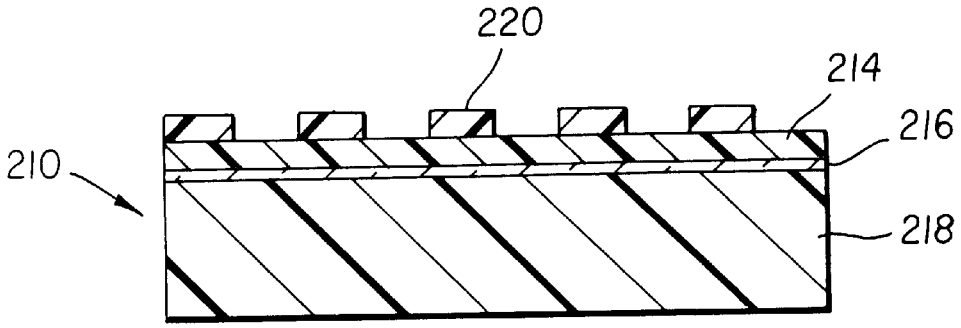
FIGS. 3*a*–3*c* illustrate a series of steps that are used in practicing the method of the present invention to produce an ink jet nozzle plate in accordance with a third embodiment of the present invention.
Figure 3B:
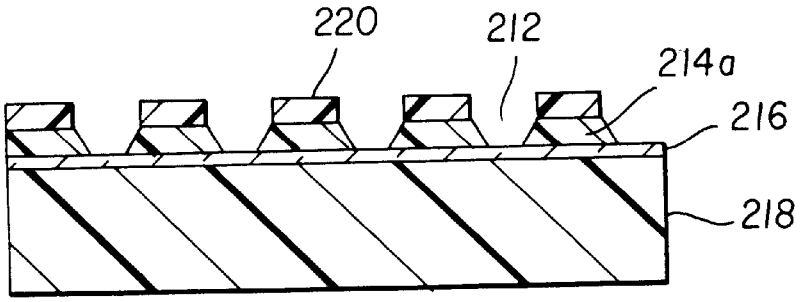
Figure 3C:
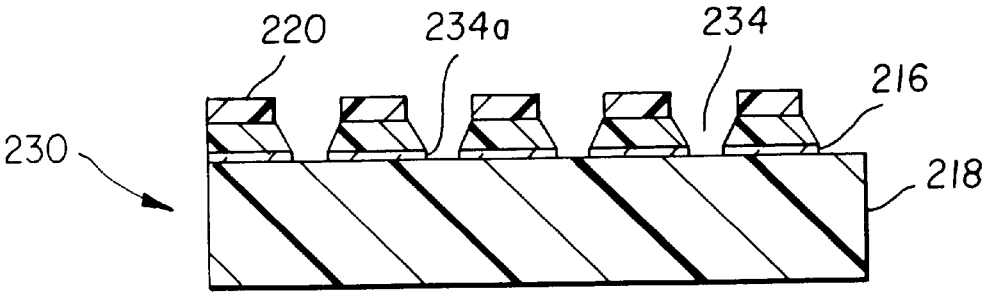

A third embodiment of the present invention, shown in FIGS. 3*a*–3*c* is particularly useful in making the top portion 40*d* of FIG. 1*e* described in the first embodiment. The substrate 10 is replace by a composite substrate 210, comprising a top substrate layer 214, a buried layer 216, and a bottom substrate layer 218. Preferably composite substrate 210 is an SOI (silicon on insulator) substrate, commercially available for the manufacture of semiconductor devices, for example high voltage silicon devices. In this preferred case, the top and bottom substrates 214 and 218 are made of silicon material and the buried layer 216 is silicon dioxide. As shown in FIG. 3*a* and 3*b*, a mask 220 is used to define openings for a shaped etch region 212, made similarly to first etched region 12 of the first embodiment. Next, as shown in FIG. 3*c*, buried layer 216 is etched, preferably by a reactive ion plasma etch, to form the first mold 230 that includes a plurality of projections 234 with vertical sides 234*a*. The vertical sides 234*a* are analogous to the vertical sides 34*a* in FIG. 1*d*. The length of the vertical wall 234*a* is precisely defined by the thickness of buried layer 216, since the bottom substrate layer 218 can act as an etch stop for etching buried layer 216. A final mold can be formed from the first mold 230 using procedures similar to the descriptions in FIGS. 1*g* to 1*j*.

The invention has been described in detail with particular reference to certain preferred embodiments thereof, but it will be understood that variations and modifications can be effected within the spirit and scope of the invention.

PARTS LIST

10 substrate
10*a* modified substrate
12 first etched region
20 mask
25 first inclined wall
30 first mold
30*a* first mold
32 shaped side wall
34 recess
34*a* vertical recess side
35 top surface
36 shaped etch region
40 first inlay
40*a* vertical wall
40*b* second inclined wall
40*c* horizontal portion
40*d* top portion
40*e* lower portion
41 top surface
50 base
50*a* conductive surface
60 first released portion
62 final mold
70 second inlay
80 ink jet nozzle plate
82 cavity region
84 bore region
84*a* vertical walls PARTS LIST (con't)
130 first mold
130*a* top surface
140 conformal insulator
140*a* modified conformal insulator
142 conductive material
142*a* bottom surface
142*b* top surface
150 base
162 final mold
210 composite substrate
212 shaped etch region
214 top substrate layer
216 buried layer
218 bottom substrate
220 mask
230 first mold
234 projection
234*a* vertical side

What is claimed is:

1. A method for forming an ink jet nozzle plate with ink jet nozzles, comprising the steps of:

a) providing a first mold formed with spaced-apart recesses;

b) providing inlay material in the spaced-apart recesses;

c) attaching a base to the inlay material;

d) separating the first mold from the inlay material and the base, thereby forming a final mold having a plurality of inlay material protrusions over the base, the protrusions and base defining the shape and the size of the ink jet nozzles;

e) providing plate forming material by electrolytic deposition or electroplating between the protrusions and over the base in the final mold; and f) releasing the plate forming material to form an ink jet nozzle plate having a plurality of ink jet nozzles.

2. The method of claim 1 wherein in step d), the inlay material overlaps portions between the spaced-apart recesses in the first mold and further includes the step of etching away such overlapping portions over the base to expose the top surface of the base.

3. The method of claim 1 wherein the base includes an electrically conductive layer.

4. The method for forming an ink jet nozzle plate of claim 3 wherein the plate forming material includes metals and metal alloys and the electrically conductive layer receives a potential to electroplate such plate forming material onto the final mold.

5. The method for forming ink jet nozzle plate of claim 4 wherein the metal includes nickel, nickel alloys, gold, gold alloys or layers of one or more such material.

6. The method of claim 1 wherein the first mold is formed from a material which includes silicon.

7. The method of claim 1 wherein the spaced-apart recesses in the first mold are formed by photolithographic patterning and etching processes.

8. The method of claim 1 further including forming a release layer or composition on the first mold which assists the separation of the first mold from the inlay material and the base.

9. The method of claim 8 further including removing the release layer or composition by thermal or chemical treatment.

10. The method of claim 1 wherein each protrusion includes a top portion bounded by vertical surfaces and a lower portion bounded by included surfaces, the vertical surfaces defining the ink jet nozzle diameter when the plate forming material is provided between the protrusions.

11. The method of claim 1 wherein the inlay material includes a polymer selected from the group consisting of silicon rubber, polyimides, polymethyl methacrylate, and hydrofluorcarbons.

12. The method of claim 1 wherein the inlay material includes conformal insulating materials having an oxide material.

13. The method of claim 1 wherein the first mold has a silicon-on-insulator (SOI) structure.

14. The method of claim 1 wherein the ink jet nozzle plate is formed with round ink jet nozzles.

15. The method of claim 1 wherein the ink jet nozzle plate is formed with nonsymmetric ink jet nozzles.

16. The method of claim 1 wherein the final mold is formed by providing a plurality of spaced projections formed of an insulating material over the conductive base and having inclined surfaces which extend up to substantially vertical surfaces having top and lower portions and which inclined and vertical surfaces correspond to surfaces to be formed in the ink jet nozzles in the ink jet plate and wherein the step of providing the patternable plate material includes depositing the plate forming material between the spaced projections and having a top surface which is disposed between the top and lower portion of the vertical surfaces to form the ink jet nozzle plate.

17. A nozzle plate made by the method of claim 1.

* * * * *